United States Patent [19]

DeWitt et al.

[11] Patent Number: 4,529,465

[45] Date of Patent: Jul. 16, 1985

[54] METHOD OF PRINT BONDING NON-WOVEN WEBS

[75] Inventors: Walter G. DeWitt, Southampton; Robert A. Gill, Abington, both of Pa.

[73] Assignee: Rohm and Haas Company, Philadelphia, Pa.

[21] Appl. No.: 466,700

[22] Filed: Feb. 15, 1983

[51] Int. Cl.[3] ..... B32B 31/12

[52] U.S. Cl. ..... 156/277; 156/291; 156/332; 156/334; 427/288; 428/195; 428/288

[58] Field of Search ..... 156/62.2, 291, 296, 156/555, 277, 385, 290; 264/119, 257, 324; 427/365, 428, 288; 428/288, 289, 290, 195, 913, 198, 296; 604/358, 370, 382; 162/184, 112

[56] References Cited

U.S. PATENT DOCUMENTS

| | | | |
|---|---|---|---|
| 3,009,822 | 11/1961 | Drelich et al. | 428/195 |
| 3,047,444 | 7/1962 | Harwood | 154/46 |
| 3,753,826 | 8/1973 | Plummer | 156/277 |
| 3,844,813 | 10/1974 | Leonard et al. | 427/365 |
| 3,898,123 | 8/1975 | Phillips et al. | 162/184 X |
| 4,041,197 | 8/1977 | Gagmé | 427/278 |
| 4,063,995 | 12/1977 | Grossman | 156/62.2 X |
| 4,291,087 | 9/1981 | Warburton, Jr. | 428/288 |

FOREIGN PATENT DOCUMENTS

| | | | |
|---|---|---|---|
| 0845367 | 8/1960 | United Kingdom | 156/62.2 |

*Primary Examiner*—Edward Kimlin
*Assistant Examiner*—Ramon R. Hoch
*Attorney, Agent, or Firm*—Michael B. Fein; Carl W. Battle

[57] ABSTRACT

This invention concerns a process for preparing non-woven webs having a very soft hand and a high tensile strength. The process involved includes print bonding a non-woven web with a formaldehyde-free binder having a glass transition temperature of about 5° C. to about 33° C., then drying, curing and then calendering the non-woven web. The resultant non-woven web has a cross dimensional water wet tensile strength of at least 150 g/in and has a softness value of at least as soft as thermally bonded polypropylene. The invention is also concerned with a product produced by the above process.

18 Claims, No Drawings

METHOD OF PRINT BONDING NON-WOVEN WEBS

BACKGROUND OF THE INVENTION

1. Field of the Invention

This invention relates to the manufacture of non-woven webs, the non-woven webs themselves, and their use in areas where soft hand, high tensile strength and flexibility are critical such as, for example, in the field of diaper coverstock.

2. Description of the Prior Art

Non-woven fabrics are conventionally manufactured by producing a web of loosely associated textile fibers disposed in sheet form, using any one of a variety of well known procedures, and then subjecting the web to a bonding operation to anchor or bond the individual fibers together. The conventional base material for non-woven fabrics is a web comprising any of the common textile fibers, or mixtures thereof. The web generally has a carded fiber structure or comprises fibrous mats in which the fibers or filaments are distributed haphazardly or in random array.

Dry laid non-woven webs may be made by carding, air-laid, spunbonded, or spunlaced procedures and then the fibers may be subsequently fixed by chemical, mechanical or thermal means. With respect to the thermal bonding procedure the fibers themselves can act as natural binders; a lower melting-point fiber is incorporated in the fiber blend, then the web is subjected to a high enough temperature to cause the lower melting point fiber to soften and bind to the fiber with the higher melting point. These thermally bonded non-wovens are assuming an ever increasing role in the market place today. Apparently, thermally bonded fibers give more comfort and more "textile-like" hand. We have developed a procedure that will produce chemically bonded non-woven with at least as good a hand and tensile strength as the thermally bonded fibers, if not superior. Polypropylene has been the fiber of choice as a thermoplastic fiber to be thermally bonded. Its particular potential has been discussed for use in the diaper coverstock industry. We have, however, produced a polyester product that is comparable, if not superior, to any product now available.

The bonding operation can be accomplished in any one of several ways such as by spray bonding, saturation bonding or print-bonding. One method is to impregnate the web continuously over its entire surface with various well known bonding agents. Such a method of impregnation is referred to as saturation bonding. This method produces a product of good strength; however, it tends to be stiff and boardlike. In order to alleviate this problem it is necessary to use a binder that is relatively soft. For example, saturation bonding is widely used in the production of diaper coverstock and a very soft binder needs to be employed. This raises yet another problem in that using a softer binder tends to produce a product with lower tensile strength.

Another bonding method is to print non-woven webs with continuous or wavy lines of binder extending traversely across the web so that the binder is applied only at localized areas which often defines a pattern on the web. This type of bonding method is used where it does not matter how little tensile strength is achieved. This method results in webs having softness and hand more nearly approaching that of a textile fabric. The problem here, however, is that such a method produces a product that lacks sufficient tensile strength for the many uses, e.g., diaper coverstock. In fact, nowhere in the prior art is such a print bonding method employed in the manufacture of diaper coverstock or the like.

From the foregoing analysis it will be seen that none of the non-woven fabrics of the prior art has been entirely satisfactory in producing a product that on the one hand has soft hand but yet, on the other, demonstrates superior wet tensile strength.

SUMMARY OF THE INVENTION

Therefore, it is an object of the present invention to provide a non-woven fabric that obviates the foregoing disadvantages. One of the objects of the invention is to provide a product that has high tensile strength while at the same time exhibits the soft hand. Another object of the invention is impart a binder pattern or design that is capable of imparting the foregoing properties to an unbonded textile web. It is still a further object to develop a more econcmical way for producing non-woven webs by using less binder and still obtaining the desired characteristics heretofore mentioned. A further object of the invention is to provide a product that exhibits a clearly visible pattern that is esthetically pleasing to the eye.

These objects and others which will become apparent from the following disclosure are achieved by the present invention which comprises, in one aspect, a process for preparing non-woven webs having a very soft hand and a high tensile strength comprising print bonding a non-woven web with a formaldehyde-free binder having a glass transition temperature of about 5° C., to about 33° C., then drying, curing and then calendering the non-woven web, the resultant non-woven web having a cross dimensional water wet tensile strength of at least 150 g/in and having a softness value of at least as soft as thermally bonded polypropylene.

In another aspect, the invention comprises the resulting webs and especially diaper coverstocks made from such webs.

DETAILED DESCRIPTION OF THE INVENTION AND THE PREFERRED EMBODIMENTS

Industry has developed many different ways to produce non-woven webs. The method of production chosen will depend on the end use to which the product will be put. In our particular case, the process needs to produce a soft product which exhibits superior wet tensile strength.

The fibers are present in the form of a non-woven mat in which they are ordered or are in haphazard array. The mat may be formed by carding when the fibers are of such character, by virtue of length and flexibility, as to be amenable to the carding operation. Carding is a preferred procedure for preparation of the mat.

The fibers may be hydrophobic or hydrophilic or a mixture and may be natural or synthetic, such as for example, polypropylene, polyester, polyolefins, jute, sinal, ramie, hemp, and cotton as well as many artificial organic textile fibers or filaments including rayon, those of cellulose esters such as cellulose acetate, vinyl resin fibers such as polyvinyl chloride, copolymers of vinyl chloride with vinyl acetate, vinylidene chloride or acrylonitrile containing a major proportion of vinyl chloride in the polymer molecule, polyacrylonitrile and copolymers of acrylonitrile with vinyl chloride, vinyl acetate, methacrylonitrile, vinyl pyridine; also condensation polymers such as polyamides or nylon tapes, polyesters such as ethylene glycol terephthalate polymers and the like. The fibers used may be those of one composition or mixtures of fibers in a given web. The preferred fibers are hydrophobic, such as those of polyester, especially poly(ethylene terephthalate), polyolefin, especially polypropylene, and blends comprising these fibers.

The length of the fibers should usually be a minimum of about 32mm in order to produce uniform webs in the carding operation, and it is preferred that the length be between 32 and 44 mm. It is generally preferred that the fibers have a denier of about 1.5. It is preferred that the polyester fibers be 1.25–2.0 denier. The polyolefin fibers are of approximately the same denier, with the range of 1.5 to 3.0 being preferred.

The dry non-woven webs of the instant invention are print bonded with a formaldehyde-free binder, having a glass transition temperature of about 5° C. to about 33° C.

The process can be carried out using any binder suitable for use in non-wovens as long as it is formaldehyde-free and has a glass transition temperature of about 5° C. to about 33° C. The binder is preferably formulated using an aqueous dispersion produced by the emulsion polymerization of ethylenically unsaturated monomers. The monomers are selected to provide the desired properties in the binder. Thus, for the applications encompassed by the present invention, they, the monomers, may provide a hard and stiffer binder. Especially useful polymers are those which yield solid polymers which have a glass transition temperature, Tg, of about 5° C. to about 33° C., preferably between 15° C. and 30° C. and most preferably between 20° C. and 25° C. The Tg value is found by plotting the modulus of rigidity against temperature; the Tg being the temperature at which the modulus first falls appreciably below the line established in the glassy region, as the temperature rises. A convenient method for determining modulus of rigidity and transition temperature is described by I. Williamson, British Plastics, 23, 87-90, 102 (September, 1950). Preferably, because of its ease, Tg is determined by calculation based on the Tg of homopolymers of individual monomers as described by *Fox, Bull. Am. Physics Soc.* 1, 3, pg. 123 (1956). Tables of the Tg of the homopolymers are widely available and include the one in "Polymer Handbook" Section II, part 2, by W. A. Less and R. A. Rutherford.

The polymerizable comonomers consist essentially of ethylenically, preferably monoethylenically, unsaturated monomers which form solid polymers in the presence of free radical catalysts. Preferred monomers are $C_4$ to $C_8$ alkyl acrylates such as n-butyl, isobutyl, sec-butyl and t-butyl, the various pentyl, hexyl, heptyl, and octyl, especially 2-ethylhexyl acrylates. Of course, mixtures of these monomers may be used. For binding polyester fibers, 35 to 50% by weight of these monomers is used. Of all of the monomers named, the most preferred is n-butyl acrylate. For the hard monomers in the case of the copolymer for the polyester fibers, preferred is 42 to 64% by weight of methyl methacrylate, styrene, alpha-methyl styrene or a mixture of these. When the fibers are polyolefin, the hard monomer is preferably 42 to 64% by weight styrene, alpha-methyl styrene or a mixture of these, styrene being preferred. The acid monomer is preferably acrylic or methacrylic acid and is present at 1 to 6% by weight of the monomers in the copolymer used with polyester fibers and 1 to 6% by weight when the fibers are polyolefin. Small amounts, desirably below 10%, of other ethylenically unsaturated monomers may be used in the copolymers with the proviso that the other monomers are copolymerizable with the required monomers. In one embodiment of the invention the binder is a water insoluble emulsion copolymer of ethylenically unsaturated monomers comprising (a) about 1 to 8%, by weight, of monoethylenically unsaturated carboxylic acid; (b) about 35 to 50%, preferably 40 to 50%, by weight of $C_4$ to $C_8$ alkyl acrylate and (c) about 42 to 64%, preferably 45% to 57%, by weight, of one or more of methyl methacrylate, styrene, alpha-methyl styrene.

To be avoided are components which give rise to formaldehyde on heating or by way of chemical reactions, particularly reversible chemical reactions; such monomers include methylol acrylamide and methylol methacrylamide, methoxymethyl acrylamide and other formaldehyde or aminoplast adducts of ethylenically unsaturated compounds.

Suitable binders that exhibit the desired traits may also be selected from the group consisting of polyvinylacetates, butadiene/styrene resins, acrylic resins, acrylic vinyl acetates and ethylene vinyl acetates, to name a few.

Suitable print bonding procedures can be silk screen or gravure roll, for example. While silk screen is practical on a small scale, we prefer the roto-gravure roll process for continuous, commercial practice. Rotogravure printing is carried out with an engraved patterened chrome plated roll equipped with a binder bath, an efficient doctoring blade and a soft rubber backup roll to maintain contact between the print roll and the pre-bonded web. The pattern of engraving on the print roll is preferably of such dimensions to permit application of 3.5 to 7.5 gms per square yard of dried binder to the web.

After the web has been print-bonded, it is subjected to a drying and curing step. In order to accomplish this, the web can be heated using any of several methods standard in the industry, including forced air ovens, infrared lamps, steam or oil heated dry cans, and the like, preferably at about 70° C. to 150° C. from 1 to 20 minutes.

After drying and curing, the web is then calendered by passing the web through two adjoining rollers, preferably cold, under pressure. Preferably, both rolls are made of steel.

This procedure does not affect the pattern that has been printed onto the web. Although calendering is used in the printing paper industry, it has not heretofore been done in the non-woven web industry, especially the diaper coverstock industry, because it would have been expected to stiffen the web.

The resultant non-woven web must have a cross-dimensional machine water wet tensile strength of at least 150 grams/inch and have a softness value of at least as soft as thermally bonded polypropylene.

The fibers in the non-woven web are generally arranged in the machine direction or cross machine direction. The fibers tend to be arranged mostly in the machine direction and, because of this orientation, the web tends to be stronger in the machine direction than in the cross machine direction. When the tensile strength of a non-woven web is determined, it is usually the cross machine direction that is tested as this represents a more accurate measure of the strength of the binder because the cross machine direction represents the weakest direction of the web.

The main measure of the wet tensile strength of a web is in terms of the load that the web can withstand. The load the web can withstand is measured in grams/inch.

The hand ratings of non-woven webs are determined using a "Blind Box" hand test. The non-woven webs are cut into approximately 8"×10" sections and rounted single ply on top of a Pampers® diaper core with the coversheet removed. The assembly is then mounted inside separate 8"×8"33 10" boxes in such a way that the webs can be felt but not seen or removed by a panelist. The panel members can feel the surface of the web as a whole. The panelists are asked to rank the samples from 1 (softest) to 5 versus a standard thermally bonded polypropylene web and rated as three. A panel of six individuals rate the mounted samples relative to the thermally bonded control.

The visual pattern printed on the non-woven web is enhanced by the addition of an opacifying agent or colorant. This opacifying agent or colorant may be added to the print bonding bath.

The opacifying agent or colorants that may be used in the instant invention may be chosen from organic pigments, inorganic pigments or dyes. Any agent which colors or opacifies the web without adversely affecting the tensile strength or hand may theoretically be used. The opacifying agent or colorant is added to the binder bath during the printing step. Up to 25% of this opacifying agent or colorant may be used, preferably 0.05% to 20% and most preferably 0.1 to 20%.

Pigments can be colored, colorless, black, white or metallic. They are solids of small particle size and remain insoluble or relatively so in the medium or binder in which they are dispersed. Color production results from the pigments selective absorption or scattering of visible light. The hiding power or opacity of a pigment depends primarily upon the ability of the dispersed particles to scatter light. Thus, the factors that influence the hiding power, are infractive index and particle size. The smaller the pigment particles, the more light is scattered. White pigments that can be used included titanium dioxide, and other lead pigments, basic lead carbonate, sulfate and antimony oxide. Two principle sources of their opacifying properties in pigment applications are the difference between their refractive index as compared with those of the medium in which they are dispersed and their small particle sizes.

As indicated, dyes may also be used for the purposes of this invention. Eyes are intensely colored substances which can be used to color different substrates. They are retained in these substrates by physical adsorption, salt or metal-complex formation, mechanical retention or by the formation of covalent bonds. It is by application methods, rather than by chemical constitution that dyes are differentiated from pigments. Dyes lose their crystal structure of dissolution or vaporization while pigments retain their crystal or particulate form throughout the application procedure.

Examples of organic pigment which can be used as the opacifying agent are the type disclosed in Ser. No. 352,396 filed Feb. 25, 1982, hereinafter incorporated by reference, and sold under the trademark ROPAQUE OP-42 by Rohm and Haas Company, and solid polystyrene beads as described in U.S. Pat. No. 3,949,138, herein incorported by reference, and sold under the trademark PP-722 by Dow Chemical Company.

Prior to print bonding the non-woven web, it is preferred to prewet in an aqueous bath containing a surfactant. Preferably the bath also contains a dilute solution of formaldehyde-free binder. Preferably the binder is applied at 1 to 15% by weight based on dried fiber, and more preferably at about 2 to 8% by weight. Preferably it is the same binder composition as used in the print bond step; however, in certain cases the prewet binder can be different.

If prebonding is done, it is preferable to use the same binder in both the prebonding and printing steps. If a different binder is used in the prebonding step, this tends to weaken the web. The theory is that if binders of different composition are used, the bonding of the print to the fiber is weakened as there is an interference with the adhesive process involved. This is true whether the first binder applied is harder or softer than the second one applied in the printing step. Additionally, the two binders must, if two are used, be members of the same class of compounds; otherwise the strength of the web is ruined.

The web, prior to being print bonded, is preferably dried in an oven or by any other conventional means known in the textile industry. The web may be heated at temperatures up to 175° C., preferably at temperatures up to 150° C. until dried.

In order to still more clearly disclose the manner in which the invention may be carried into practice, several specific embodiments will hereinafter be described in detail. It should be understood, however, that this is done purely by way of example and not for the purpose of delineating the breadth of the invention or limiting the ambit of the appended claims.

EXAMPLES

Example 1

A non-woven web is produced using a Dacron 372W polyester fiber sold by DuPont having a 1.5 denier per filament and being 1.5 inches in length. The final product is a web containing 14–14.5 grams of fiber per square yard.

The non-woven web is pre-bound by saturation technique by passing the web through a bath containing an aqueous solution of 98.8% water, 0.9% binder and 0.3% surfactant on total bath weight. The binder employed has the following composition: 48.5 BA/32.5 St/14 MMA//4 AA/1 MAA, and is formaldehyde-free with a glass transition temperature of 5.6° C.

The resultant prebonded web contains 6% binder, by weight.

The prebonded web is dried and then print-bonded with a 46% solids bath containing the same binder as in the prebonding step and which also contains 1.25% surfactant, solids on binder solids, to give a bath having a pH of 6.5, and viscosity of 1800 cps.

The web is print-bonded with a chrome plated roll having a chevron pattern with a soft rubber backing roll at a pressure of 10 lbs. per linear inch, subsequently dried and cured at 150° C.

The finished basis weight of 20–21.5 grams per square yard and wet cross-dimensional tensile strength of 165 grams/inch and wet machine direction of 1780–1975 grams/inch is obtained.

The product is then calendered between two smooth chrome plated rolls at room temperature at 25 lbs per linear inch to give soft webs which rate 2.7 to 3.0 in the Hand Box Test versus the thermally bonded control of 3.0.

Example 2

Example 1 is repeated except that the binder used is a styrene/butadiene resin. Its composition is as follows: 73 St/25 butadiene/2 acrylic acid and has a Tg of 25° C.

Acceptable results are obtained in that a wet tensile strength above 150 g/inch and a hand rating of 3.0 or less is obtained.

Example 3

Example 1 is repeated except that a polyvinylacetate binder is used. The binder has a composition of 98 polyvinylacetate/2 acrylic acid and has a Tg of about 30° C.

Acceptable results are obtained in that a wet tensile strength above 150 g/inch and a hand rating of 3.0 or less is obtained.

Example 4

Example 1 was repeated except that the styrene in the binder is replaced by methylmethacrylate. The binder has a Tg of about 6.

Acceptable results are obtained in that a wet tensile strength above 150 g/inch and a hand rating of 3.0 or less is obtained.

Example 5

The same procedure of Example 1 was run, the difference being the use of a different binder in the pre-bonding step than in the print bonding step. The results are indicated in the following table:

| Pre-Bond Binder | Print-bond Binder | Wet Tensile Strength |
|---|---|---|
| 61 BA/20 St/14 MMA/ 4 AA/1 MAA | 61 BA/20 St/14 MMA/ 4 AA/1 MAA | 93 |
| 61 BA/29 St/15 MMA/ 4 AA/1 MAA | 51 BA/20 St/14 MMA/ 4 AA/1 MAA | 182 |
| 61 BA/20 St/14 MMA/ 4 AA/1 MAA | 48.5 BA/32.5 St/ 14 MMA/4 AA/1 MAA | 242 |
| 51 BA/30 St/14 MMA/ 4 AA/1 MAA | 48.5 BA/32.5 St/ 14 MMA/4 AA/1 MAA | 282 |
| 77 BA/19 St/14 MMA/ 3.5 AA/1.5 IA | 48.5 BA/32.5 St/ 14 MMA/4 AA/1 MAA | 300 |
| 48.5 BA/32.5 St/ 14 MMA/4 AA/1 MAA | 48.5 BA/32.5 St/ 14 MMA/4 AA/1 MAA | 535 |

Using different binders in the prebonding and print bonding steps can give acceptable results in wet tensile strength measurements.

Example 6

The same procedure is carried out as in Example 1 except that the calendering step is left out. The resultant web demonstrates an unacceptable hand. The cross-dimensional tensile strength is unaffected.

We claim:

1. A process for preparing non-woven webs having a very soft hand and a high tensile strength comprising print-bonding a dry-laid non-woven web with a formaldehyde free binder having a glass transition temperature of about 15° C. to about 33° C., then drying, curing and then calendering the bonded non-woven web under pressure between adjoining metal rolls; the resultant non-woven web having a cross-directional water wet tensile strength of at least 150 g/in and having a softness value of at least as soft as thermally bonded polypropylene.

2. The process of claim 1 wherein the binder is applied at 10 to 50% of the dry fiber, by weight.

3. The process of claim 1 wherein prior to print-bonding the non-woven web is prewet in an aqueous bath containing a surfactant.

4. The process of claim 1 wherein the glass transition temperature of the binder is from about 20° C. to about 25° C.

5. The process of claim 1 wherein the binder is polyvinylacetate, butadiene/styrene, acrylic, acrylic/vinyl acetate, or ethylene/vinyl acetate.

6. The process of claim 1 wherein the binder is a water-insoluble, hydrophobic emulsion copolymer of ethylenically unsaturated monomers comprising.

(a) about 1 to 8%, by weight, of monoethylenically unsaturated carboxylic acid;

(b) about 35 to 50%, by weight, of $C_4$ to $C_8$ alkyl acrylate, and (c) about 42 to 64%, by weight, of one or more of methyl methacrylate, styrene, alpha-methyl styrene.

7. The process of claim 6 wherein (a) is about 1 to 8%, (b) is about 40 to 50% and (c) is about 45 to 57%.

8. The process of claim 1 wherein the non-woven web is dried at temperatures of between 70° to 150° C.

9. The process of claim 8 wherein the non-woven web is dried and cured for about 1 to about 20 minutes.

10. The process of claim 1 wherein the non-woven web is calendered at temperatures of from 15° C. to 35° C. at 10 to 200 lbs per linear inch at a rate of from 100 to 2000 feet per minute.

11. The process of claim 1 wherein from .01% to 25% of an opacifying agent is added to the binder.

12. The process of claim 11 wherein the opacifying agent is an organic pigment.

13. The process of claim 12 wherein the opacifying agent is a water-insoluble particulate polymer having a diameter of from about 0.48 to about 0.6 microns.

14. The process of claim 11 wherein the opacifying agent is an inorganic pigment.

15. The process of claim 13 wherein the inorganic pigment is titanium dioxide.

16. The process of claim 11 wherein the opacifying agent is a dye.

17. The process of claim 1 wherein prior to the print bonding step the non-woven web is prebonded by saturating said web with a dilute solution of formaldehyde-free binder and applied at 1 to 15% of the dry fiber by weight, and then dried.

18. The process of claim 17 wherein the dilute solution of formaldehyde-free binder contains surfactant.

* * * * *